United States Patent [19]

Franklin

[11] 4,085,473

[45] Apr. 25, 1978

[54] DECK PLATFORM EXTENSION FOR BOATS

[76] Inventor: Dwaine R. Franklin, 1845 Arizona Ave., Yuma, Ariz. 85364

[21] Appl. No.: 719,927

[22] Filed: Sep. 2, 1976

[51] Int. Cl.[2] ..... B63B 29/00

[52] U.S. Cl. ..... 9/1.7; 9/1.6; 114/188

[58] Field of Search ..... 16/176, 171, 168, 169, 16/128 R; 114/258, 188, 194; 9/1.7, 1.6, 1.1, 7

[56] References Cited

U.S. PATENT DOCUMENTS

| | | | |
|---|---|---|---|
| 1,030,801 | 6/1912 | Berault | 16/176 |
| 1,150,230 | 8/1915 | Schurz | 9/1.7 |
| 3,613,137 | 10/1971 | Eccles | 9/1.6 |
| 3,789,444 | 2/1974 | McCord | 9/7 |
| 3,862,456 | 1/1975 | Fisher | 9/7 |

FOREIGN PATENT DOCUMENTS

| | | | |
|---|---|---|---|
| 1,429,395 | 3/1976 | United Kingdom | 9/1.6 |

*Primary Examiner*—Trygve M. Blix
*Assistant Examiner*—D. W. Keen
*Attorney, Agent, or Firm*—Drummond, Nelson & Ptak

[57] ABSTRACT

A removable deck platform is attached to the stern transom of a boat for extending the effective deck space of the boat rearwardly. Hinges are used to removably attach the deck platform to the transom. Triangular support braces attached to the bottom of the deck platform extend downwardly from the platform and rest against the transom when the platform is in place. A railing extends upwardly around the outer periphery of the platform, and the effective useful length of the boat is enhanced by attaching two rearwardly facing swivel chairs to the upper edge of the stern of the boat.

8 Claims, 9 Drawing Figures

DECK PLATFORM EXTENSION FOR BOATS

BACKGROUND OF THE INVENTION

With increases in the amount of leisure time available to them, more and more people are purchasing power boats for recreational purposes. These power boats range in size from small dingys with outboard motors to relatively large boats having inboard engines and capable of sleeping several persons. Boats of intermediate sizes are used for a variety of purposes, such as joy-riding, water skiing and fishing. Of the boats in the intermediate size classes, many are designed for specialized purposes, such as water skiing or fishing. Others, however, are designed for general use, which results in compromises of the features which are most desirable for a particular use such as water skiing or fishing.

Many recreational boats ranging in size from approximately 18 feet to 30 feet using inboard engines, large outboard engines, or what have become known as inboard/outboard engines and drive units presently are being manufactured. Most of these boats are well suited for pleasure boating or sightseeing and are fairly well adaptable for water skiing. Generally, however, it is difficult to fish from such boats.

Specialized fishing boats have been made in which the seating arrangements are such that two rearwardly facing swivel chairs are used; however, seating which otherwise could be provided around the sides and stern of such boats is eliminated. As a consequence, if a boat is outfitted for fishing purposes, it does not adapt readily to sightseeing or pleasure cruising.

Furthermore, it often is desirable to provide increased deck space for a pleasure boat which can be used to effectively increase the length of a boat of a given length; so that (for example) a boat owner of a 20-foot boat may increase the deck space to the equivalent of a 22-foot boat without incurring the expense otherwise necessary to buy a larger boat. In addition, it is desirable to provide some means for increasing the effective length or deck space of a boat when desired, but which may be quickly and easily removed whenever the additional deck space is not desired.

Extensions have been proposed for mounting on the transom of boats for use as platforms or steps to assist water skiers or swimmers in entering the boat from the water. Other removable platforms have been proposed for use with fishing boats for the storage of nets and other gear on the stern of the boat but, in effect, outside the boat; so that the water and other debris carried by the nets does not enter the boat. In addition, such platform extensions for this purpose free the interior space of the boat for other uses. Thus, a small boat effectively is made larger.

For general purpose pleasure boats, it is desirable to provide some means for readily adapting them for fishing or water skiing while still retaining the interior seating arrangements commonly used when the boat is used for sightseeing or pleasure riding. In addition, it is desirable to extend the effective useful length of a boat in an economical fashion and to quickly and easily adapt it to increased seating capacity of a flexible nature.

SUMMARY OF THE INVENTION

Accordingly, it is an object of this invention to provide a deck extension for a boat.

It is another object of this invention to provide an improved removable deck extension for attachment to the hull of a boat.

It is an additional object of this invention to provide an improved removable deck attachment for the transom of a boat used in conjunction with additional seats mounted on the upper edge of the stern of the boat to create an improved seating arrangement.

It is yet another object of this invention to modify a pleasure boat to one particularly adapted for fishing or the like by the addition of a removable rear deck attached to the transom and a deck chair mounted on the stern of the boat just above the transom and facing rearwardly.

It is still another object of this invention to provide an improved removable rear deck structure for a boat for use in conjunction with rearwardly facing deck chairs mounted on the stern just above the transom and using the removable deck as a foot rest to increase the different uses to which the boat readily may be adapted.

In accordance with a preferred embodiment of this invention, a removable deck platform having a width which is less than its length, is removably attached to the hull of a boat below the upper edge of the hull. A railing is attached to the upper side of the deck platform and extends around at least a major part of the periphery of the platform.

In a more specific embodiment, a pair of swivel deck chairs are mounted to the stern of the boat just above the transom so that when a person sits in one of the chairs, his feet rest upon the platform which is removably attached to the transom.

DETAILED DESCRIPTION

Figure 1:
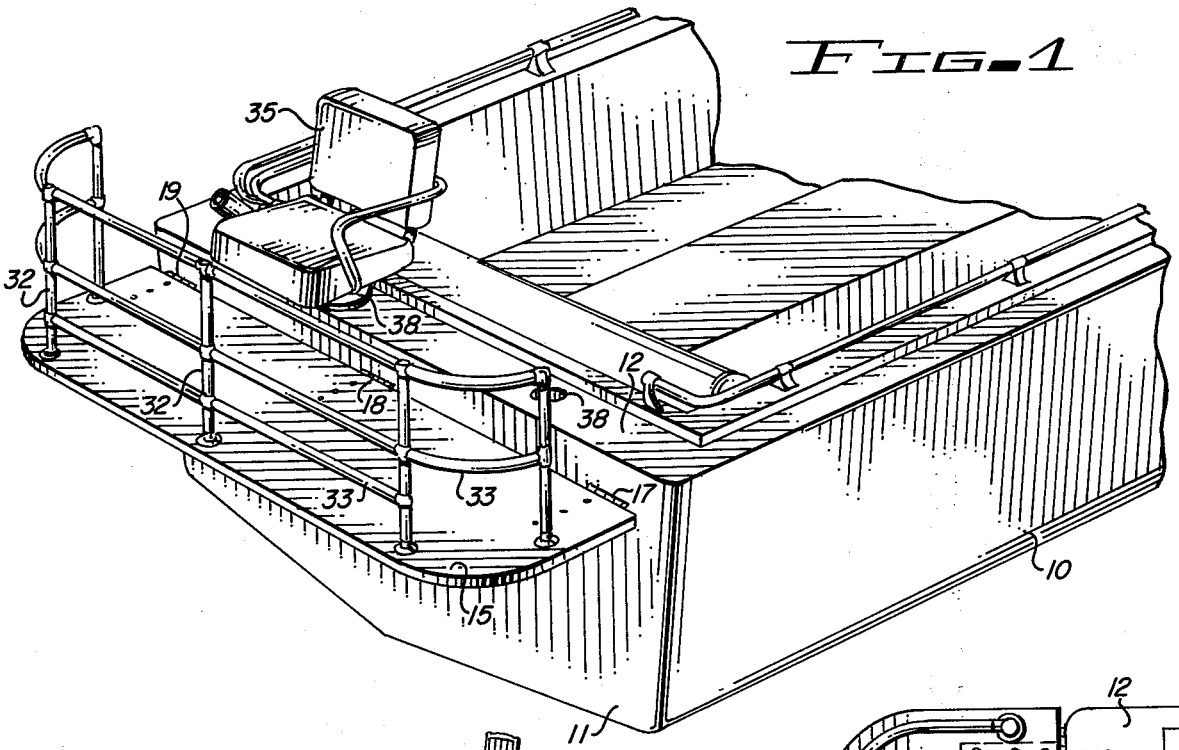
FIG. 1 is a perspective view of a preferred embodiment of the invention.

Referring now to the drawings, the same reference numbers are used throughout the different figures to designate the same or similar components.

In FIG. 1, the stern portion of a typical power boat 10 (either inboard or inboard/outboard) of a medium size, for example, 18 feet to 30 feet, is illustrated in a partially broken-away form. The stern of the boat 10 terminates in a transom 11 and this transom is of relatively substantial construction to provide structural strength and support for the inboard/outboard engine components and the like. The upper portion of the stern above the transom 11 has a relatively narrow ledge 12, typically 6 inches to 10 inches wide. Normally, the stern portion of boats of this type, namely power pleasure boats, is fitted with a forward facing seat along the stern portion and/or facing seats on each side of the hull of the boat 10 in the stern area. The central and bow portions of the boat 10 are capable of having any number of configurations which are not important to an understanding of this invention since it can be used with boats of many different types.

To the otherwise conventional boat 10, a removable deck platform 15 has been added extending substantially all the way across the stern of the boat and located a few inches (approximately 6 to 10 inches) below the top edge 12 of the stern. The deck 15 is removably attached to the hull of the boat on the transom 11 by means of three hinges 17, 18 and 19, each having one portion 21 secured to the transom 11 and a mating portion 22 secured to the underside of the deck 15. Each of these hinges is held together in a conventional manner by a hinge pin 25; so that when the two portions of the hinge 21 and 22 are aligned with one another and secured together with the pin 25, the deck 15 is securely attached to the transom of the boat.

Figure 2:
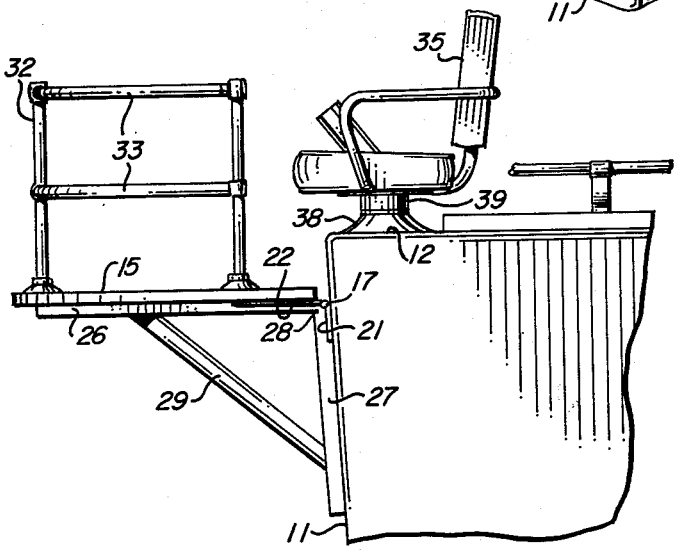
FIG. 2 is a side view of a preferred embodiment of the invention shown in FIG. 1.

As shown most clearly in FIG. 2, a pair of reinforcing support members are used to support the deck 15 in a horizontal position extending outwardly from the transom 11 of the boat. Each of these support members preferably is formed of a first U-shaped channel member 26 of aluminum or other suitable material attached to the underside of the deck 15 by suitable fasteners, such as bolts or rivets. A downwardly extending channel member 27, similar to the channel member 26, is rigidly attached to each of the channel members 26 at a junction point 28; and in addition, the two channel members 26 and 27 of each support member are connected together by a support rod 29 to form a strong triangular support as shown most clearly in FIG. 2. The angle at the point 28 is made to compensate for the slope of the transom 11 for the boat on which the platform 15 is to be attached and may vary for different boats having differently sloped transoms.

When the hinge pins 25 of the hinges 17, 18 and 19 are in place, the weight of the deck 15 and its associated supports causes it to bear downwardly through the support rods 29 against the members 27 which, in turn, place the force on the transom 11 of the boat. This is a very stable deck extension for the boat but one which is readily removable if it is not desired or whenever the boat is to be stored.

To increase the versatility of the deck 15 and also, to significantly increase the safety of using such a deck, a railing is attached to the upper surface of the deck around the major portion of its outer periphery. As shown most clearly in FIG. 1, this railing typically includes spaced upright posts 32 interconnected by horizontal tubular railing bars 33. The posts 32 and the bars 33 preferably are made of aluminum or other suitable material of the type commonly used in boat construction.

As shown in FIG. 1, the railing does not extend all of the way to the edge of the deck 15 which is attached to the transom 11 of the boat. Instead, a small space of approximately one foot is left between the end post 32 and the transom of the boat 11. This space permits use of the platform 15 as a means of leaving the boat and entering the water by swimmers and also provides a place where persons in the water can pull themselves up onto the platform 15 and enter the boat. It is possible that in some uses of a boat with the platform 15 attached to it, a detachable ladder could be extended from the platform 15 at this space on either end where there is no railing. If this type of access to and from the platform 15 is not desired, the railing could extend all of the way to the edge of the platform 15 which is attached to the transom 11 of the boat. In either event, the railing typically has a height of approximately 2 to 3 feet.

Figure 3:
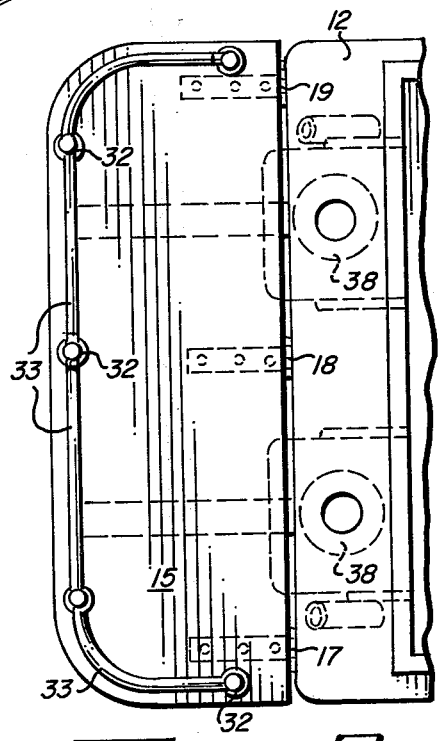
FIG. 3 is a top view of the embodiment shown in FIGS. 1 and 2.
Figure 4:
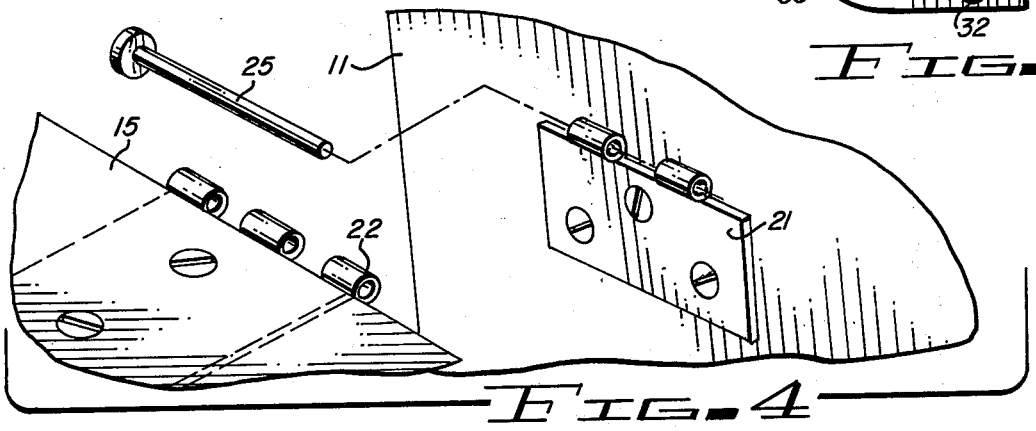
FIG. 4 is a detailed view of a portion of the embodiment shown in FIGS. 1, 2 and 3.
Figure 5:
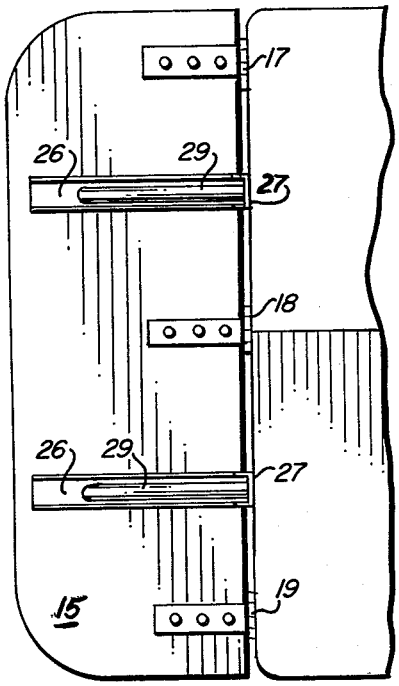
FIG. 5 is a bottom view of the embodiment shown in FIG. 1.

In conjunction with the deck 15, the boat 10 as shown in FIGS. 1, 2 and 3 further is modified by adding a pair of swivel or rotating chairs 35 of the type commonly employed in fishing boats. Normally, chairs such as the chairs 35 are located forward of the stern of the boat inside the hull enclosure and are mounted to the floor of the boat in the stern region. If chairs, such as the chairs 35, are so located, generally no other seating arrangement is possible in this portion of the boat since the chairs occupy the central area at the stern. These chairs are typically used in fishing boats.

As shown in FIGS. 1 and 2, however, the chairs 35 are mounted on the upper portion 12 of the stern of the boat. This is a generally heavily reinforced area in boats commonly manufactured today and is easily capable of supporting the weight of the chairs 35. The chairs 35 also each are modified to eliminate the post which generally extends from the base member 38 of the chair to the bottom of the chair 39. Thus, the chairs 35 are mounted close to the surface 12 at the stern of the boat.

When the chairs 35 are placed in the position shown in FIGS. 1 and 2, the upper surface of the deck 15 is located approximately 8 to 10 inches below the surface 12. This, then, provides a normal distance between the upper surface of the seat of the chairs 35 and the deck 15, so that a person sitting in one of the chairs 35 may place his feet on the deck 15 in a normal fashion. Anytime that a person wishes to get up from a chair 35, he merely stands on the deck 15, and the railing 32, 33 provides a safety support in the event it is needed for that purpose. It is to be understood that two chairs 35 are located on the rear of the boat, but only one has been shown in FIG. 1 to avoid cluttering of the drawing. The swivel plate 38 which is attached to the surface 12 of the stern of the boat is shown for both chairs in FIGS. 1 and 3; and in FIG. 3, both of the chairs are shown in dotted line outline form so that their relationship to the stern of the boat and the deck 15 may be readily ascertained.

Figure 9:
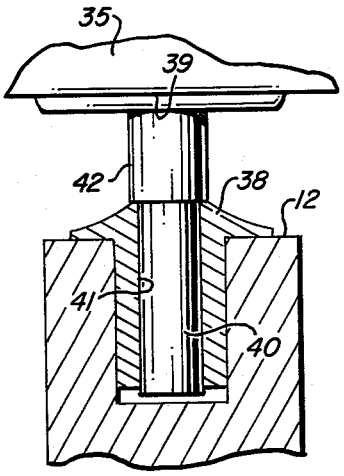
FIG. 9 shows a detail of a portion of the embodiment shown in FIGS. 1 and 2.

FIG. 9 is a detailed view, partially in cross-section, of the transom at the stern of the boat showing the manner of mounting the base 38 of the chair 35 on the stern surface 12. Extending downwardly from the bottom 39 of the chair is a shaft 40, which passes through a circular opening or hole 41 in the base 38. The shaft 40 terminates in a wider portion 42 which rests on the top of the base member 38 and permits the chair 35 to be pivoted in any direction as desired. Other chair constructions and other means of attaching them to the stern of the boat on the surface 12 may be used. The construction shown in FIG. 9 is merely illustrative of one type of construction which could be employed. Also, if the swivel feature of the chair 35 is not desired, a chair which is not capable of such swivelling or turning may be used. Ideally, a structure such as that shown in FIG. 9 is used; so that when the chair is not desired, it simply may be lifted out of the hole 41 and removed from the boat. The installation and removal of a chair with this type of construction is simple and can be accomplished in a minimum length of time.

Figure 6:
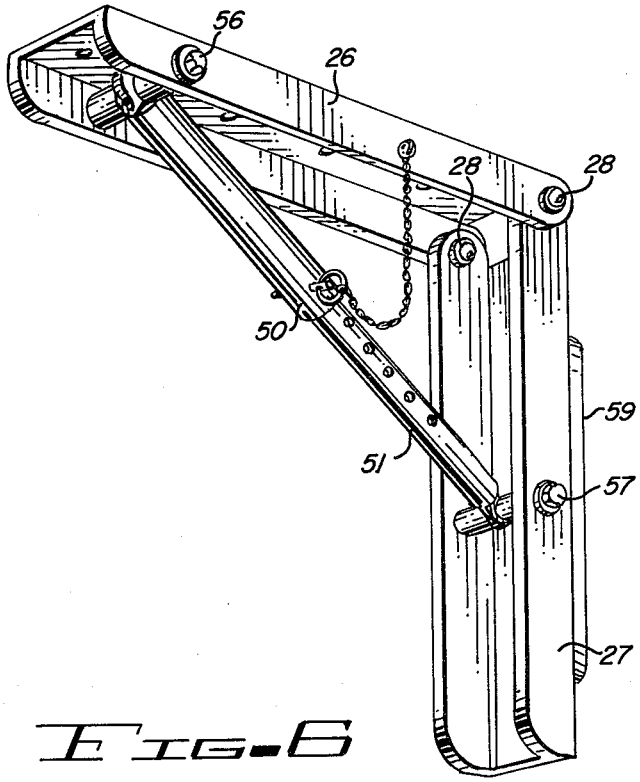
FIGS. 6, 7 and 8 show a portion of an alternative embodiment of the invention.
Figure 7:
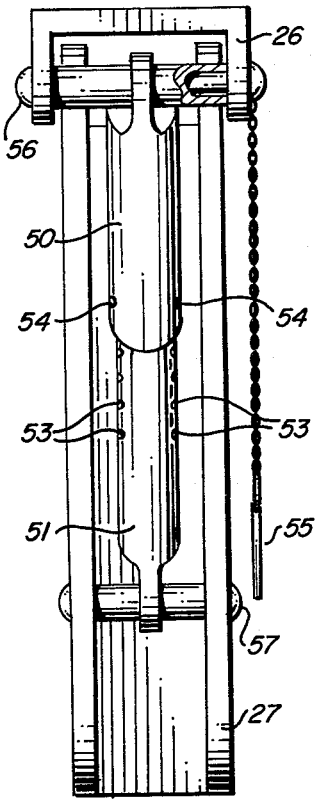
Figure 8:
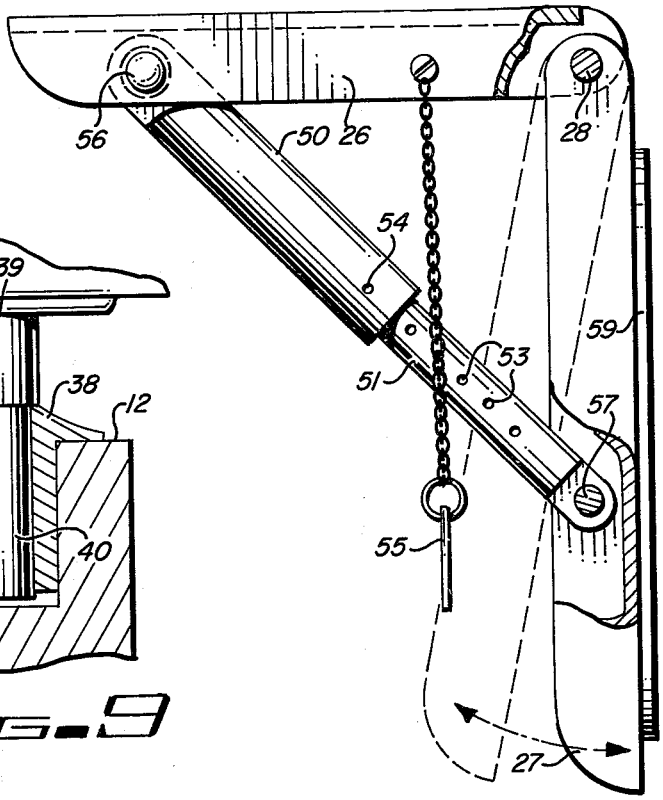

FIGS. 6, 7 and 8 show a modification of the support members used to support the deck 15 in place of the rigid support members 26, 27 and 29, which have been described previously. Whenever a deck is built to fit a particular boat, the structure shown in FIG. 2 most likely will be employed, since it is a rigid structure with maximum strength and rigidity. However, if the deck 15 is to be used with different makes or types of boats, the angle formed between the strut members 26 and 27 shown in FIG. 2 may not be proper for boats having a slope at the transom 11 which differs from the one for which the particular strut member illustrated in FIG. 2 is made.

As a consequence, to obtain a more universal application of the deck 15 to different makes, types and sizes of boats, a support structure of FIGS. 6, 7 and 8, having a telescoping diagonal support rod comprised of a pair of telescoping sections 50 and 51 may be used. The telescoping support section may be of any suitable configuration, and the one shown in these figures is typical. In the illustrated telescoping support section, the internal member 51 has a number of spaced holes 53 located at regular intervals along its length. The outer member 50 has a similar aligned pair of spaced holes 54 in it, and a key 55 is passed through the holes 54 in the member 50 and the set of holes 53 in the member 51 which adjust the angle of the support to be such that the deck 15 is held in a horizontal relationship as illustrated in FIG. 2.

When a telescoping support member 50, 51 is used, the members 50 and 51 are pivotally mounted on shafts 56 and 57 to the corresponding support members 26 and 27 instead of being permanently welded or fastened to these members as described previously in conjunction with the embodiment shown in FIG. 2. Similarly, the members 26 and 27 must be connected to each other at the point 28 by a pivotal or hinge connection to permit angular movement between them as shown in FIG. 8 to adjust the angle as needed. Telescoping support connectors of the type illustrated in FIGS. 6, 7 and 8 are available in a number of different forms, but the one illustrated is readily adaptable for the purpose of supporting the deck 15 and is relatively inexpensive.

To minimize the possibility of marring the finish on the transom 11 of the boat, a pad 59 also may be attached to the support member 27 to rest against the transom of the boat 11.

It can be seen that use of the deck 15 requires minimum alteration to the transom 11 of the boat 10. It only is necessary to attach the hinge members 21 to the transom at the location desired for the deck to obtain the desired vertical height from the top of the deck 15 to the seat of the chair 35. It is not necessary to use any additional fastening means through the members 27 since the weight of the deck, itself, is sufficient to hold the deck against the boat transom because of the locations of the hinges 17, 18 and 19 relative to the support members 26 and 27.

It is apparent that the deck platform member and chairs 35 installed in the manner described above and shown in the drawings substantially increases the versatility of the boat with which they are used and increases the effective length of the boat with a minimum of effort and expense. Anytime that the boat owner does not wish to use the deck 15, it can be quickly and easily removed along with the chairs 35. It should be noted that while the most convenient location for the deck 15 and chairs is believed to be on the stern of the boat, other locations on the hull could be used, if desired.

I claim:

1. An improvement for attachment to the transom on the stern of the hull of a boat having a recessed cockpit and a gunwale surrounding the recessed cockpit adjacent the transom including, in combination:

a deck platform member having a length substantially equal to the width of the stern of the boat for mounting across the stern of the boat;

support means attached to said deck platform member for supporting said platform against the transom of the boat;

first fastening means for attachment to the upper portion of the transom of the boat; second fastening means attached to said deck platform member;

means for removably interconnecting said first and second fastening means together to permit said deck platform member to be removably attached to the transom of the boat;

railing means attached to the upper side of said deck platform member and extending around at least a part of the periphery of said platform member; and at least one chair mounted on the upper edge of the hull at the stern of the boat and facing rearwardly, and said platform member is spaced downwardly from the upper edge of the hull at the stern of the boat a sufficient distance to provide a natural footrest outboard of the hull of said boat for a person sitting in said chair over the gunwale portion of said boat substantially outboard of the cockpit area thereof.

2. The combination according to claim 1 wherein the width of said deck platform member is less than the length thereof, and said support means comprises a plurality of triangularly shaped support members attached to the underside of said deck platform member and having downwardly extending legs for resting against the transom of said boat; said first fastening means comprises a first hinge portion attached to the transom of the boat and said second fastening means comprises a mating hinge portion attached to said deck platform member at the edge abutting the transom of the boat; and said means for removably interconnecting said first and second fastening means together comprises a hinge pin.

3. The combination according to claim 1 wherein said first and second fastening means comprise first and second portions, respectively, of hinge means; and said means for removably interconnecting said first and second fastening means comprises hinge pin means.

4. The combination according to claim 1 wherein said support means comprises a substantially triangularly shaped support member with a first side attached to the underside of said deck and a second side extending downwardly from the first side for abutting against the transom of the boat.

5. The combination according to claim 4 wherein said railing extends substantially around the ends and the edge of said deck platform member opposite the edge abutting the transom and extends upwardly from said platform member a distance of the same order of magnitude as the width of said platform member.

6. The combination according to claim 4 wherein the triangular support member comprises a third side interconnecting the first and second sides thereof and extendable to different lengths, and said first and second sides of said triangular support member are joined by a hinged connection to permit adjusting the angle between the first and second sides for attaching said deck platform member to boats having transoms of different slopes.

7. The combination according to claim 1 wherein first and second chairs as mounted on the upper edge of the hull at the stern of the boat in a side-by-side, rearwardly facing direction.

8. The combination according to claim 7 wherein said first and second chairs are removably mounted on swivel platforms to permit them to be turned in any direction.

* * * * *

UNITED STATES PATENT AND TRADEMARK OFFICE

CERTIFICATE OF CORRECTION

PATENT NO. : 4,085,473

DATED : April 25, 1978

INVENTOR(S) : Dwaine R. Franklin

It is certified that error appears in the above-identified patent and that said Letters Patent are hereby corrected as shown below:

Column 6, Claim 7, Line 61:

"as" should be --are--.

Signed and Sealed this

*Twenty-ninth* Day of *August 1978*

[SEAL]

*Attest:*

RUTH C. MASON
*Attesting Officer*

DONALD W. BANNER
*Commissioner of Patents and Trademarks*